US012305132B2

(12) United States Patent
Tian et al.

(10) Patent No.: US 12,305,132 B2
(45) Date of Patent: May 20, 2025

(54) PROCESS FOR PREPARING FUEL GAS THROUGH GRADED PYROLYSIS AND GASIFICATION OF POWDERED COAL

(71) Applicant: China University of Petroleum (East China), Qingdao (CN)

(72) Inventors: Yuanyu Tian, Qingdao (CN); Yingyun Qiao, Qingdao (CN); Kechang Xie, Qingdao (CN); Jingxian Wang, Qingdao (CN); Zhenghong Luo, Qingdao (CN); Yanpeng Zhang, Qingdao (CN); Yiliang Tian, Qingdao (CN); Ruotong Cui, Qingdao (CN)

(73) Assignee: CHINA UNIVERSITY OF PETROLEUM (EAST CHINA), Shandong (CN)

( * ) Notice: Subject to any disclaimer, the term of this patent is extended or adjusted under 35 U.S.C. 154(b) by 0 days.

(21) Appl. No.: 18/770,179

(22) Filed: Jul. 11, 2024

(65) Prior Publication Data

US 2025/0075138 A1 Mar. 6, 2025

(30) Foreign Application Priority Data

Sep. 5, 2023 (CN) ..... 202311137963.1

(51) Int. Cl.

| | |
|---|---|
| ***C10J 3/54*** | (2006.01) |
| ***C10J 3/56*** | (2006.01) |
| ***C10J 3/57*** | (2006.01) |
| ***C10J 3/72*** | (2006.01) |
| ***C10J 3/84*** | (2006.01) |

(52) U.S. Cl.

CPC ..... *C10J 3/54* (2013.01); *C10J 2300/093* (2013.01); *C10J 2300/1606* (2013.01); *C10J 2300/1807* (2013.01); *C10J 2300/1861* (2013.01)

(58) Field of Classification Search

None

See application file for complete search history.

(56) References Cited

U.S. PATENT DOCUMENTS

| | | | | |
|---|---|---|---|---|
| 9,000,056 B2 * | 4/2015 | Bi | ..... | C10K 1/30 518/700 |
| 2012/0238646 A1 * | 9/2012 | Bi | ..... | C10J 3/721 422/643 |

FOREIGN PATENT DOCUMENTS

| | | | | |
|---|---|---|---|---|
| CN | 102965157 A | | 3/2013 | |
| CN | 106220461 A | * | 12/2016 | ..... C07C 1/00 |
| CN | 214327647 U | * | 10/2021 | |

* cited by examiner

*Primary Examiner* — Joseph D Anthony

(74) *Attorney, Agent, or Firm* — Volpe Koenig

(57) ABSTRACT

A process for preparing fuel gas through gasification of powdered coal, comprising: contacting powdered coal and ash residue in a riser reactor under hydrogenation conditions to perform a pyrolysis reaction and a gas-phase tar cracking reaction; subjecting it to a primary gas-solid separation to obtain a gasified gas and a solid fraction; subjecting the gasified gas to a secondary gas-solid separation to obtain a solid fraction containing fine particle semi-coke and a gasified gas; subjecting the solid fraction to a gasification calcination reaction, flowing the gasified coal gas and the high-temperature ash residue u into the riser reactor; subjecting the solid fraction containing fine particle semi-coke to a melting gasification reaction, falling the liquid residue to the material-returning device of fluidized bed for cooling and solidification, and feeding the second high-temperature gasified coal gas to the riser reactor via a high-temperature gasified gas returning pipe.

10 Claims, 1 Drawing Sheet

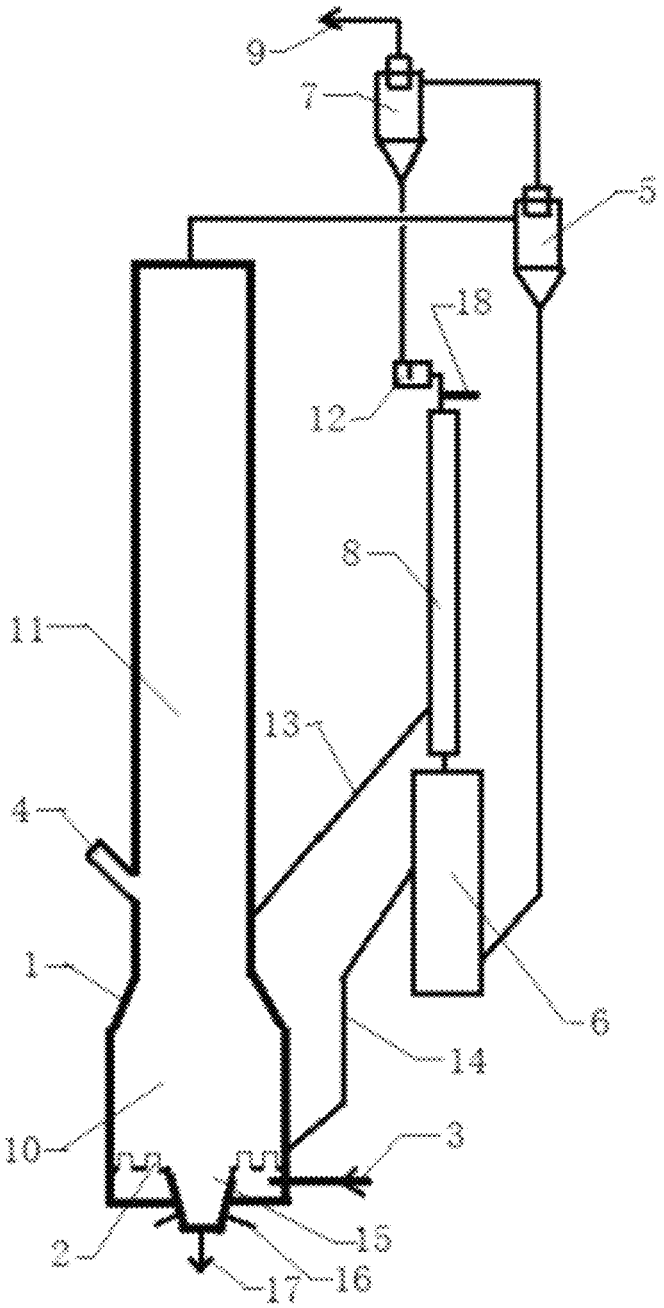
9
7
5
18
12
8
11
13
4
1
6
14
10
3
2
15
16
17

PROCESS FOR PREPARING FUEL GAS THROUGH GRADED PYROLYSIS AND GASIFICATION OF POWDERED COAL

CROSS-REFERENCE TO RELATED APPLICATIONS

The application claims priority to the Chinese Application No. 202311137963.1, filed on Sep. 5, 2023, which is specifically and entirely incorporated herein by reference.

FIELD

The present disclosure relates to the technical field of coal gasification, and in particular to a process for preparing fuel gas through graded pyrolysis and gasification of powdered coal.

BACKGROUND

Gasification is the leading technology for clean and efficient energy source utilization of coal, both methane content and calorific value of the fuel gas are the key indicators, but methane content and tar control are contradictory. The gasification is mainly classified into fixed-bed/moving-bed lump coal gasification technology, fluidized-bed powdered coal gasification technology, and entrained-flow bed gasification technology, as well the hydro-gasification process the coal gasification process utilizing the nuclear energy, underground gasification process, etc., which are under development. The fixed-bed/moving-bed coal gasification technology can produce fuel gas by using the lump coal, air, and water vapor, the fuel gas has high methane content and calorific value, the technology is mature, the stepwise heat utilization is reasonable and efficient, the equipment investment is small, and the gasification cost is low, but it has disadvantages that the high tar content of fuel gas is prone to cause pipe blockage and secondary pollution of phenol-containing wastewater, the content of residual carbon in ash residue is high (10%-30%), the gas permeability of material column requires the use of high-quality lump coal, the severe restriction of coal type causes many enterprises to suffer from the high cost of raw material, low gasification capacity, and high production costs. The powdered coal fluidized-bed gasification technology can continuously produce fuel gas by using the powdered coal, oxygen, and water vapor, it directly feeds various powdered coals at low cost as the raw material, it has the features of moderate fuel gas production capacity, high gasification efficiency, low environmental pollution, higher equipment investment and low production costs of fuel gas, but it has disadvantages such as low methane content and calorific value of the fuel gas, high fly ash content which has high content of residual carbon (20%-30%), and high content of residual carbon in the ash residue (7-15%), namely the difficult problem of upward vomiting and downward diarrhea. Entrained-flow bed coal gasification technology can continuously produce fuel gas at high-temperature by using fine powdered coal, oxygen, and water vapor, the technology has characteristics such as high production capacity of fuel gas, high gasification efficiency, large equipment investment, and lower content of residual carbon in the ash residue (2-7%), but it has disadvantages that the fuel gas contains little methane, the calorific value is low, powdered coal requires high fineness, the energy consumption of grinding is high, the reaction temperature is high (around 1,400° C.), the reaction time is short (several seconds), the feedstock powdered coal cannot be preheated, oxygen consumption is high, energy utilization is unreasonable, in particular, the oxygen consumption of the feedstock coal water slurry is high, and the efficient utilization of carbon is low.

The reactivity of coal varies during the different conversion stages, the coal can be easily gasified during the first 80% to 90% conversion stage and is difficult to be gasified during the last 10% to 20% conversion stage, the current coal gasification technologies often regard coal as a single substance and strive to convert it completely through a single process, thus the residual carbon in the difficult gasification during the last 10% to 20% conversion stage determines the rigorous overall gasification reaction conditions (high temperature, high pressure, long residence time), thus it is urgently required to develop the graded gasification technologies and devices with low energy consumption based on the reaction characteristics of the various stages of coal gasification, such that the technologies and devices can accommodate the feedstock requirements of the fluidized bed and achieve the gasification effect of an entrained-flow bed.

CN102965157A discloses a powdered coal combined type circulating fluidized bed step pyrolysis gasification technology, the technology comprises the following steps: feeding powdered coal of 0-6 mm and small quantity of limestone into an entrained flow reactor at the middle lower part of a combined type circulating fluidized bed, mixing with gasified coal gas and circulating ash, and lifting upward to perform hydropyrolysis; and performing gas-solid separation, wherein high-temperature coarse semi-coke subjected to first-step separation returns to the bottom of the circulating fluidized bed and reacts with an oxidant and water vapor at 800-1,100° C. to generate gasified coal gas which flows upward with the circulating ash to form material circulation; high-temperature fine semi-coke subjected to second-step separation is fed into an entrained bed communicated with the middle lower part of the fluidized bed in a Y-shaped manner, and reacts at 1,200-1,600° C.; the generated high-temperature gas and liquid ash obliquely flow downward out of the entrained bed in homonymous rotational flow; the high-temperature gas rises to enter the circulating fluidized bed to supply heat to the gasification of the fluidized bed; and the liquid ash flows downward to a circulating ash layer of a turbulent fluidized bed and is subjected to heat exchange condensation to become solid ash. The process has been industrially applied so far, and the fuel gas produced through graded pyrolysis and gasification of powdered coal has high content of methane and a calorific value of up to 1,400 Kcal/Nm$^3$, but the fuel gas does not contain tar, there are not the secondary contamination of phenol-containing wastewater and the upward vomiting and downward diarrhea phenomenon of the fluidized bed gasification, and achieves the entrained-flow bed gasification effect. However, when the liquid residue of the entrained-flow bed flows downwards to the turbulent fluidized bed, it is prone to cause the phenomenon of poor circulation, solidification, and blockage, which directly affects the long-period, secure, and stable operation of the combined circulating fluidized bed; in addition, although the residual carbon content of the externally discharged gasified ash residue is significantly reduced, the ash residue still contains a portion of semi-coke, thus the further calcination is urgently needed to reduce the content of residual carbon, thereby achieving the clean and efficient energy source utilization of coal.

SUMMARY

The present disclosure aims to overcome the defects in the prior art concerning the poor long-cycle operational stability of combined circulating fluidized bed, easy blockage of liquid residue, and insufficient efficient utilization of carbon and provides a process for preparing fuel gas through graded pyrolysis and gasification of powdered coal, the process has the characteristics such as low oxygen consumption, high gasification efficiency, low carbon residue content in the ash residue, and long cycle operational stability.

To achieve the above objectives, the present disclosure provides a process for preparing fuel gas through graded pyrolysis and gasification of powdered coal, the process comprises the following steps:

(1) contacting powdered coal having a particle size of not greater than 3 mm and ash residue in a riser reactor under hydrogenation conditions, performing a pyrolysis reaction and a gas-phase tar cracking reaction;

(2) subjecting the product obtained from step (1) to a primary gas-solid separation to obtain a gasified gas containing fine particle semi-coke and a solid fraction containing coarse particle semi-coke;

(3) subjecting the gasified gas containing fine particle semi-coke to a secondary gas-solid separation to obtain a solid fraction containing fine particle semi-coke and a gasified gas;

(4) feeding at least a portion of the solid fraction containing coarse particle semi-coke obtained from the primary gas-solid separation into a stepped turbulent fluidized bed through a material-returning device of fluidized bed, and contacting with an oxidant and water vapor to carry out a gasification calcination reaction to obtain a first high-temperature gasified coal gas and a high-temperature ash residue, flowing the first high-temperature gasified coal gas and at least a portion of high-temperature ash residue upwards and feeding into the riser reactor to provide the hydrogen atmosphere and the ash residue in step (1);

(5) feeding at least a portion of the solid fraction containing fine particle semi-coke obtained from the secondary gas-solid separation into an entrained-flow bed through a material-returning device of entrained-flow bed, and contacting with a gasifying agent to carry out a melting gasification reaction to obtain a second high-temperature gasified coal gas and a liquid residue, falling the liquid residue to the material-returning device of fluidized bed for cooling and solidification, and feeding the second high-temperature gasified coal gas to the riser reactor via a high-temperature gasified gas returning pipe to provide heat and hydrogenation atmosphere for the pyrolysis reaction and the gas-phase tar cracking reaction of step (1).

The process for preparing fuel gas through graded pyrolysis and gasification of powdered coal provided by the present disclosure can realize the phased and sequential pyrolysis and gasification of powdered coal and the calcination of residue at different locations of the same equipment under the different conditions according to the pyrolysis and gasification reaction characteristics of coal, the process has technical advantages such as low oxygen consumption, high gasification efficiency, low carbon residue content in the ash residue; in addition, the resultant synthesis gas from the process is rich in methane, the process can be adapted to the feedstock requirement of the fluidized bed and achieve the gasification effect of entrained-flow bed, eliminates the tar during the gasification process, does not generate phenol-containing wastewater, and solves the difficult problem of upward vomiting and downward diarrhea during the fluidized bed gasification process; moreover, the process has the advantages such as high gasification intensity, small equipment size, low consumption of steel materials, and greatly reduced fixed investment; the feedstock particle size requirement is low, it does not require a high crushing energy consumption, and the process has characteristics such as simple operation, convenient startup and shutdown, desirable operational continuity, and strong coal adaptability; the partial desulfurization in the reactor is realized, and the purification process is simplified; the high temperature gas and the liquid ash residue generated in the entrained-flow bed can simultaneously supply heat to the circulating fluidized bed, the liquid ash residue can be converted into the solid ash residue for discharging so as to eliminate the phenomenon of the flow disturbance, solidification and blockage of the molten slag, the ash discharging process is simple, and the operation is smooth.

BRIEF DESCRIPTION OF THE DRAWINGS

FIG. 1 is a schematic diagram illustrating an apparatus system used in a process for preparing fuel gas through graded pyrolysis and gasification of powdered coal in an embodiment of the present disclosure.

THE DESCRIPTION OF REFERENCE SIGNS

1. Combined riser of circulating fluidized bed
2. Gas distributor
3. Gas inlet pipe
4. Powdered coal feed opening
5. Primary gas-solid separator
6. Material-returning device of fluidized bed
7. Secondary gas-solid separator
8. Entrained-flow bed
9. Coal gas outlet
10. Stepped turbulent fluidized bed
11. Riser reactor
12. Material-returning device of entrained-flow bed
13. High-temperature gasified gas returning pipe
14. First-stage material returning tube
15. Calcination fluidized bed
16. Calcination gasifying agent feed inlet
17. Slag-drip opening
18. Entrained-flow bed gasifying agent inlet

DETAILED DESCRIPTION

The terminals and any value of the ranges disclosed herein are not limited to the precise ranges or values, such ranges or values shall be comprehended as comprising the values adjacent to the ranges or values. As for numerical ranges, the endpoint values of the various ranges, the endpoint values and the individual point values of the various ranges, and the individual point values may be combined with one another to produce one or more new numerical ranges, which should be deemed have been specifically disclosed herein.

Unless otherwise specified in the present disclosure, the orientation terms such as "upper, lower, left, right" generally refer to the orientation as shown with reference to the accompanying figures. The terms "inner" and "outer" refer to the inside and outside of the components relative to the contours thereof.

The present disclosure provides a process for preparing fuel gas through graded pyrolysis and gasification of powdered coal, the process comprises the following steps:

(1) contacting powdered coal having a particle size of not greater than 3 mm and ash residue in a riser reactor under hydrogenation conditions, performing a pyrolysis reaction and a gas-phase tar cracking reaction;

(2) subjecting the product obtained from step (1) to a primary gas-solid separation to obtain a gasified gas containing fine particle semi-coke and a solid fraction containing coarse particle semi-coke;

(3) subjecting the gasified gas containing fine particle semi-coke to a secondary gas-solid separation to obtain a solid fraction containing fine particle semi-coke and a gasified gas;

(4) feeding at least a portion of the solid fraction containing coarse particle semi-coke obtained from the primary gas-solid separation into a stepped turbulent fluidized bed through a material-returning device of fluidized bed, and contacting with an oxidant and water vapor to carry out a gasification calcination reaction to obtain a first high-temperature gasified coal gas and a high-temperature ash residue, flowing the first high-temperature gasified coal gas and at least a portion of high-temperature ash residue upwards and feeding into the riser reactor to provide the hydrogen atmosphere and the ash residue in step (1);

(5) feeding at least a portion of the solid fraction containing fine particle semi-coke obtained from the secondary gas-solid separation into an entrained-flow bed through a material-returning device of entrained-flow bed, and contacting with a gasifying agent to carry out a melting gasification reaction to obtain a second high-temperature gasified coal gas and a liquid residue, falling the liquid residue to the material-returning device of fluidized bed for cooling and solidification, and feeding the second high-temperature gasified coal gas to the riser reactor via a high-temperature gasified gas returning pipe to provide heat and hydrogenation atmosphere for the pyrolysis reaction and the gas-phase tar cracking reaction of step (1).

In the present disclosure, the powdered coal is subjected to the hydrogenation high-temperature pyrolysis and gas phase tar high-temperature cracking in a riser reactor, such that the produced coal gas contains high content of methane and does not contain tar, and there is not the secondary pollution of phenol-containing wastewater; in addition, the coarse particle semi-coke and ash residue are subjected to the circulated fluidization and gasification in the riser reactor, the fine particle semi-coke is gasified in an entrained-flow bed, the process reduces oxygen consumption, solves the difficult problem of upward vomiting, achieves the low cost and low rigorous operation comparable to fluidized bed gasification and the high carbon conversion efficiency of gasification effect comparable to an entrained-flow bed gasification; then the vertically falling entrained-flow bed gasification molten liquid residue is rapidly mixed with fluidized coarse particle semi-coke and ash residue in a material-returning device of fluidized bed to solidify with temperature drop, thereby overcoming the difficult problem of poor circulation, solidification and blockage of the high-temperature gasification slag in the entrained-flow bed; and finally, the returned particle semi-coke and ash residue are subjected to further gasification and calcination and subsequently discharged outwards, thereby solving the difficult problem of downward diarrhea concerning the high content of residual carbon in the outwards discharged slag following the fluidized bed gasification.

According to some preferred embodiments of the present disclosure, the reaction temperature of the riser reactor in step (1) is within the range of 800-1,000° C.

In a further preferred embodiment, the mass ratio of the powdered coal to the ash residue is 1:(20-80), preferably 1:(30-50).

In the present disclosure, the coarse particle semi-coke refers to a semi-coke particle with a particle size larger than 30 μm; and the fine particle semi-coke refers to a semi-coke particle with a particle size less than or equal to 30 μm.

In the present disclosure, "semi-coke" has the conventional definition in the art and refers to the carbonaceous residue derived from coal pyrolysis and gasification. In the present disclosure, the "particle size" refers to the equivalent diameter of an equal volume sphere of said particle.

In the present disclosure, subjecting the product obtained from step (1) to a primary gas-solid separation to obtain a gasified gas containing fine particle semi-coke and a solid fraction containing coarse particle semi-coke, and then subjecting the gasified gas containing fine particle semi-coke to a secondary gas-solid separation to obtain a solid fraction containing fine particle semi-coke and a gasified gas, as to achieve the separation the particles of different sizes. It is understood that the solid fraction containing coarse particle semi-coke and the solid fraction containing fine particle semi-coke also contain ash residue, respectively. The specific conditions and modes of the primary gas-solid separation and the secondary gas-solid separation are not particularly limited in the present disclosure, only if the separation products can be obtained, and those skilled in the art can make adjustments according to the practical requirements.

In the present disclosure, the gasified gas obtained by the secondary gas-solid separation in step (3) can be directly output as product gas, or further minute dust removal step can be carried out to remove the minute particle semi-coke and/or ash residue in the gasified gas, and the those skilled in the art can choose any appropriate method according to the actual composition of the gasified gas. The invention has no special limitation in this regard, and the minute particle semi-coke refers to a semi-coke particle with a particle size ≤5 μm.

The present invention does not impose particular limitation on the amount of oxidant and water vapor, as long as the solid fraction containing coarse particle semi-coke can be fully gasified. Preferably, relative to 1 kg the solid fraction containing coarse particle semi-coke, the total flow volume of the oxidant and water vapor is 0.2-3 L, preferably 0.5-2.5 L.

According to the present disclosure, the oxidant in step (4) is selected from the oxygen-containing gas, wherein the volume content of oxygen in the oxygen-containing gas is from 20% to 100%; for example, the oxygen-containing gas may be air, oxygen, or oxygen-enriched air, etc. Preferably, the volume ratio of the oxidant to water vapor is within the range of 1:(0.3-2.5), more preferably within the range of 1:(0.5-2). Preferably, the stepped turbulent fluidized bed is further provided with a gas distributor, such that the oxidant is contacted with the solid fraction containing coarse particle semi-coke on the gas distributor for carrying out the gasification reaction, which is conducive to further improving the reaction efficiency.

According to some preferred embodiments of the present disclosure, the temperature of the gasification calcination reaction in step (4) is within the range of 800-1,100° C., preferably within the range of 800-950° C.

According to the present disclosure, a first high-temperature gasified coal gas and a high-temperature ash residue are obtained through the gasification calcination reaction, the first high-temperature gasified coal gas, and at least a portion of the high-temperature ash residue move upwards and enter into the riser reactor, to provide the hydrogen atmosphere and ash residue in step (1), thereby forming a material circulation, which is conducive to reducing the oxygen consumption, and cracking the difficult problems such as low calorific value of the fuel gas, the tar can hardly be reduced and the upward vomiting of the fluidized bed gasification process, achieving the low cost and low rigorous operation comparable to fluidized bed gasification and the high carbon conversion efficiency of gasification effect comparable to an entrained-flow bed gasification.

According to the present disclosure, in step (5), at least a portion of the solid fraction containing fine particle semi-coke obtained from the secondary gas-solid separation passes through a material-returning device of entrained-flow bed and enters into an entrained-flow bed, and contacts with a gasifying agent to carry out a melting gasification reaction. By performing steps (4) and (5), the coarse particle semi-coke and fine particle semi-coke are subjected to gasification, respectively, the process can reduce the consumption of oxygen-containing gas and improve the carbon conversion efficiency and gasification effectiveness. According to the present disclosure, the second high-temperature gasified coal gas obtained from the melting gasification reaction comprises CO, $H_2$, $CO_2$, and $H_2O$, etc., and is substantially free of methane.

The present invention does not impose particular limitation on the amount of the gasifying agent, as long as the solid fraction containing fine particle semi-coke can be fully gasified. Preferably, relative to 1 kg the solid fraction containing fine particle semi-coke, the total flow volume of the gasifying agent is 0.1-3 L, preferably 0.2-2.5 L.

Preferably, the gasifying agent comprises an oxygen-containing gas and water vapor, wherein the volume content of oxygen in the oxygen-containing gas is within the range of 20-100%; for example, the oxygen-containing gas may be air, oxygen, or oxygen-enriched air. Preferably, the volume ratio of the oxygen-containing gas to water vapor is 1:(0.5-10), more preferably 1:(0.7-5).

According to some preferred embodiments of the present disclosure, the temperature of the melting gasification reaction in step (5) is within the range of 1,200-1,600° C.

According to the present disclosure, the entrained-flow bed is vertically arranged, such that the liquid residue resulting from the melting gasification reaction in step (5) falls vertically into a material-returning device of fluidized bed, it is understandable that mixing the high-temperature liquid residue with a large amount of solid fraction containing coarse particle semi-coke at a volume of above 200 times in the material-returning device of fluidized bed, making the high-temperature liquid residue rapidly cool down and solidify without sticking into a block so as to avoid causing "blocked bed" problem, thereby solving the difficult problem of poor circulation, solidification and blockage of the entrained-flow bed high-temperature gasification slag.

According to the present disclosure, it is preferable that the process further comprises: feeding the remaining portion of high-temperature ash residue obtained from the gasification calcination reaction in step (4) into a calcination fluidized bed, mixing with a calcination gasification agent for calcination to obtain a ash residue of gasification without semi-coke and then discharged. In the preferable circumstance, the process can further reduce the carbon content of the gasification residue to less than 2%, which is advantageous for high-value utilization of the gasification residue.

According to the present disclosure, the temperature of the mixing calcination is preferably within the range of 900-1,100° C.

In the present disclosure, the calcination gasifying agent may be an oxygen-containing gas having an oxygen content of 20-100% by volume, preferably oxygen. The present invention does not impose particular limitation on the amount of the calcination gasifying agent, as long as the high-temperature ash residue can be fully calcinated. Preferably, relative to 1 kg the high-temperature ash residue, the total flow volume of the calcination gasifying agent is 0.5-3 L, preferably 1-2 L.

According to some preferred embodiments of the present disclosure, the operating state of the material-returning device of fluidized bed is a turbulent flow state, the returning wind of the material-returning device of fluidized bed is selected from water vapor and/or oxidizing gas, preferably a mixture of oxygen-containing gas and water vapor; preferably at a volume ratio of 1:(2-10). The oxidizing gas is oxygen-containing gas with the volume content of oxygen within the range of 20-100%, such as air, oxygen, or oxygen-enriched air.

According to some preferred embodiments of the present disclosure, the apparatus used in the process of preparing fuel gas through graded pyrolysis and gasification of powdered coal is as shown in FIG. 1, the apparatus comprises the following components:

- a combined riser of circulating fluidized bed 1, including, in sequential connection from bottom to top, a calcination fluidized bed 15, a stepped turbulent fluidized bed 10, and a riser reactor 11; wherein the calcination fluidized bed 15 is preferably a cone-shaped fluidized bed, its bottom is provided with a calcination gasifying agent feed inlet 16 and a slag-drip opening 17; the bottom of the stepped turbulent fluidized bed 10 is preferably provided with a gas inlet pipe 3, and a gas distributor 2 is preferably arranged above the gas inlet pipe 3; the riser reactor 11 is arranged with a powdered coal feed opening 4 at a lower part thereof, and is provided with a product outlet at the top thereof;
- the product outlet of the riser reactor 11 is connected to the feed inlet of a primary gas-solid separator 5 to feed the products from the pyrolysis reaction and the gas-phase tar cracking reaction to the primary gas-solid separator 5 for performing the primary gas-solid separation. The outlet at the top of the primary gas-solid separator 5 is connected to the feed inlet of a secondary gas-solid separator 7, and the outlet at the bottom is connected to the feed inlet at a lower part of the material-returning device of fluidized bed 6;
- the secondary gas-solid separator 7 is provided with a coal gas outlet 9 at the top. The bottom outlet of the secondary gas-solid separator 7, a material-returning device of entrained-flow bed 12 and an entrained-flow bed 8 are in connection through pipelines, an entrained-flow bed gasifying agent inlet 18 is further provided on the pipeline between the material-returning device of entrained-flow bed 12 and the entrained-flow bed 8; a lower part of the entrained-flow bed 8 is provided with a high-temperature gasified gas returning pipe 13 which is connected to the riser reactor 11 to feed the high-temperature gasified gas obtained from the melting gasification reaction into the riser reactor; preferably, the connection port between the high-temperature gasified gas return pipe 13 and the riser reactor is disposed below the powdered coal feed opening 4; and the bottom discharge port of the entrained-flow bed 8 is connected to a fluidized bed reactor 6, the fluidized bed reactor 6 is connected to a step turbulent bed 10 through a first-stage material returning tube 14 to carry out a gasification calcination reaction of the solid fraction containing coarse particle semi-coke.

The process for preparing fuel gas through graded pyrolysis and gasification of powdered coal of the present disclosure is described below with reference to the accompanying drawings, the process for preparing fuel gas through graded pyrolysis and gasification of powdered coal is carried out in the apparatus as shown in FIG. 1, in particular, the powdered coal having a particle size of not greater than 3 mm is fed through a conveyer into the middle lower part of a riser reactor 11 in a combined riser of circulating fluidized bed 1, and rapidly mixed with the upwardly elevated high-temperature gasified gas and recycled ash residue, the hydrogenation rapid pyrolysis and gas-phase tar cracking staged reaction are performed simultaneously with the upward elevation process. The resulting product is subjected to multilevel gas-solid separations at the top of the riser reactor 11, and the gas is discharged outwards as the product gas; specifically, the coarse particle semi-coke and ash residue obtained from the primary gas-solid separation are returned through a material-returning device of fluidized bed to a stepped turbulent fluidized bed 10 at the bottom of the combined riser of circulating fluidized bed 1, and carry out a gasification calcination reaction with an oxidant and water vapor at the temperature of 800-1,100° C., the generated first high-temperature gasified coal gas and a portion of ash residue flow upwardly to form a recycle, and a portion of calcination slag is discharged outwards; the high-temperature fine particle semi-coke obtained from the secondary gas-solid separation is fed through a material-returning device of entrained-flow bed 12 into an entrained-flow bed 8, which is connected to the lower part of the riser reactor 11 and the material-returning device of fluidized bed 6, respectively, the melting gasification reaction is performed at the temperature range of 1,200-1,600° C., and the resulting liquid residue falls vertically into a material-returning device of fluidized bed 6 to be rapidly cooled and granulated, and the generated second high-temperature gasified coal gas obliquely and downwards flows into the lower part of the riser reactor 11 from the middle lower part of the entrained-flow bed 8, in order to provide heat and a hydrogenation atmosphere for the high-temperature hydrogenation and rapid pyrolysis of powdered coal.

The present disclosure will be described in detail below with reference to examples.

Example 1

The powdered coal having a particle size of 0-3 mm added from the powdered coal feeding 4 was fed into the middle lower part of a riser reactor 11 of a combined riser of circulating fluidized bed 1, and rapidly mixed with the gasified gas and the recycled ash residue, wherein a mass ratio of the powdered coal to the ash residue was 1:50; the hydrogenation rapid pyrolysis and gas-phase tar cracking staged reaction were performed simultaneously with the upward elevation process, and the reaction temperature of the riser reactor was 850° C.;

The obtained product was subjected to multilevel gas-solid separations at the top of the composite lifting pipe, the high-temperature coarse particle semi-coke having a particle size more than 30 μm separated from a primary gas-solid separator 5 was returned through a fluidized bed 6 and a first-stage material returning tube 14 to a stepped turbulent fluidized bed 10 at the bottom of the composite lifting pipe, and carried out a gasification reaction on a gas distributor 2 at the temperature of 1,000-1,100° C. with oxygen and water vapor (the volume ratio of oxygen to water vapor was 1:1.1, relative to 1 kg the solid fraction containing coarse particle semi-coke, the total flow volume of the oxidant and water vapor is 1.2 L) added through a gas inlet pipe 3, the generated high-temperature gasified gas and a portion of ash residue flowed upwards to form a material circulation; the gas separated from the secondary gas-liquid separator 7 was discharged outwards from the coal gas outlet 9 as the product gas, the high-temperature fine semi-coke having a particle size of less than or equal to 30 μm obtained from the separation and ash residue were fed through a material-returning device of entrained-flow bed 12 into an entrained-flow bed 8, which was connected to the lower part of the riser reactor 11 and the material-returning device of fluidized bed 6, respectively, and carried out a melting gasification reaction at the temperature range of 1,300-1,600° C. with oxygen and water vapor (the volume ratio of oxygen and water vapor was 1:0.7, relative to 1 kg the solid fraction containing fine particle semi-coke, the total flow volume of the gasifying agent is 0.9 L) fed through the entrained-flow bed gasifying agent inlet 18, the liquid residue vertically fell into the material-returning device of fluidized bed 6 to be rapidly cooled and solidified, the returning wind of the material-returning device of fluidized bed was a mixture of oxygen and water vapor (the volume ratio of oxygen to water vapor was 1:7), the generated high-temperature gasified coal gas obliquely and downwards flowed from the middle lower part of the entrained-flow bed 8 into the lower part of the riser reactor 11 through the high-temperature gasified gas returning pipe 13, in order to provide heat and a hydrogenation atmosphere for the high-temperature hydrogenation and rapid pyrolysis of powdered coal;

The discharged ash residue in the stepped turbulent fluidized bed 10 entered into the calcination fluidized bed 15, and the oxygen fed through a calcination gasifying agent feed inlet was used for calcination and separation (relative to 1 kg the high-temperature ash residue, the total flow volume of the calcination gasifying agent is 1.2 L), and the gasification ash residue without semi-coke was discharged through a slag-drip opening 17. The industrial demonstration application results of the 100 ton/day Shenmu powdered coal composite lifting pipe graded pyrolysis and oxygen gasification indicated that the carbon conversion rate was 99.5 wt. %, the methane content in fuel gas was 8.5 wt. %, the heat value was 2,850 Kcal/Nm$^3$, the fuel gas did not contain tar, the content of carbon residue in the externally discharged gasified slag was 1.2 wt. %, and the gasification equipment did not have the defects of poor circulation, solidification and blockage of slag in the long-term operation. The process solved the difficult problems of upward vomiting and downward diarrhea of fluidized bed gasification and produced the fuel gas having a high content of methane and did not contain tar, and the long-cycle safe and stable operation of the gasification apparatus was ensured.

Example 2

The powdered coal having a particle size of 0-3 mm added from the powdered coal feeding 4 was fed into the middle lower part of a riser reactor 11 of a combined riser of circulating fluidized bed 1, and rapidly mixed with the gasified gas and the recycled ash residue, wherein a mass ratio of the powdered coal to the ash residue was 1:30; the hydrogenation rapid pyrolysis and gas-phase tar cracking staged reaction were performed simultaneously with the upward elevation process, and the reaction temperature of the riser reactor was 830° C.;

The obtained product was subjected to multilevel gas-solid separations at the top of the composite lifting pipe, the high-temperature coarse particle semi-coke having a particle size more than 30 μm separated from a primary gas-solid separator 5 was returned through a fluidized bed 6 and a first-stage material returning tube 14 to a stepped turbulent fluidized bed 10 at the bottom of the composite lifting pipe, and carried out a gasification reaction on a gas distributor 2 at the temperature of 1,000-1,100° C. with air and water vapor (the volume ratio of air to water vapor was 2:1, relative to 1 kg the solid fraction containing coarse particle semi-coke, the total flow volume of the oxidant and water vapor is 2.5 L) added through a gas inlet pipe 3, the generated high-temperature gasified gas and a portion of ash residue flowed upwards to form a material circulation; the gas separated from the secondary gas-liquid separator 7 was discharged outwards from the coal gas outlet 9 as the product gas, the high-temperature fine semi-coke having a particle size of less than or equal to 30 μm obtained from the separation and ash residue were fed through a material-returning device of entrained-flow bed 12 into an entrained-flow bed 8, which was connected to the lower part of the riser reactor 11 and the material-returning device of fluidized bed 6, respectively, and carried out a melting gasification reaction at the temperature range of 1,200-1,400° C. with air and water vapor (the volume ratio of air and water vapor was 0.2:1, relative to 1 kg the solid fraction containing fine particle semi-coke, the total flow volume of the gasifying agent is 2.2 L) fed through the entrained-flow bed gasifying agent inlet 18, the liquid residue vertically fell into the material-returning device of fluidized bed 6 to be rapidly cooled and solidified, the returning wind of the material-returning device of fluidized bed was water vapor, the generated high-temperature gasified coal gas obliquely and downwards flowed from the middle lower part of the entrained-flow bed 8 into the lower part of the riser reactor 11 through the high-temperature gasified gas returning pipe 13, in order to provide heat and hydrogenation atmosphere for the high-temperature hydrogenation and rapid pyrolysis of powdered coal;

The discharged ash residue in the stepped turbulent fluidized bed 10 entered into the calcination fluidized bed 15, and the oxygen fed through a calcination gasifying agent feed inlet was used for calcination and separation (relative to 1 kg the high-temperature ash residue, the total flow volume of the calcination gasifying agent is 2 L), and the gasification ash residue without semi-coke was discharged through a slag-drip opening 17. The industrial demonstration application results of the 100 ton/day Shenmu powdered coal composite lifting pipe graded pyrolysis and air gasification indicated that the carbon conversion rate was 99 wt. %, the methane content in fuel gas was 4.2 wt. %, the heat value was 1,400 Kcal/Nm$^3$, the fuel gas did not contain tar, the content of carbon residue in the externally discharged gasified slag was 1.5 wt. %, and the gasification equipment did not have the defects of poor circulation, solidification and blockage of slag in the long-term operation.

Example 3

The process was performed according to the same process as Example 1, except that the oxygen in each step in Example 1 was replaced with oxygen-enriched air (oxygen content was 50 vol %), and the returning wind of the material-returning device of fluidized bed was replaced with water vapor.

The industrial demonstration application results of the 100 ton/day Shenmu powdered coal composite lifting pipe graded pyrolysis and gasification indicated that the carbon conversion rate was 99 wt. %, the methane content in fuel gas was 6.5 wt. %, the heat value was 2,000 Kcal/Nm$^3$, the fuel gas did not contain tar, the content of carbon residue in the externally discharged gasified slag was 1.3 wt. %, and the gasification equipment did not have the defects of poor circulation, solidification and blockage of slag in the long-term operation.

Comparative Example 1

The gasification of pulverized gas was performed according to the method in Example 1 of CN102965157A, the industrial demonstration application results of the 100 ton/day Shenmu powdered coal composite lifting pipe graded pyrolysis and gasification indicated that the carbon conversion rate was 98 wt. %, the methane content in fuel gas was 8 wt. %, the heat value was 2,800 Kcal/Nm$^3$, the fuel gas did not contain tar, the content of carbon residue in the externally discharged gasified slag was 2.0 wt. %, the circulation of slag in the gasification device was not smooth, the slag was prone to solidify and block, thus the long-cycle operation of the device was influenced.

As shown by the Examples and Comparative Example, the process for preparing fuel gas through the composite lifting pipe and graded pyrolysis and gasification of powdered coal provided by the present disclosure can realize the phased and sequential pyrolysis and gasification of powdered coal and the calcination of residue at different locations of the same equipment under the different conditions according to the pyrolysis and gasification reaction characteristics of coal and its chemical components, the process has technical advantages such as low oxygen consumption, high gasification efficiency, low carbon residue content in the ash residue; in addition, the resultant synthesis gas is rich in methane, can be adapted to the feedstock requirement of the fluidized bed, and can achieve the gasification effect of entrained-flow bed, eliminates the tar during the gasification process, does not generate phenol water, and solves the difficult problem of upward vomiting and downward diarrhea during the fluidized bed gasification process; the high temperature gas and the liquid ash residue generated in the entrained-flow bed can simultaneously supply heat to the circulating fluidized bed, the liquid ash residue is converted into the solid ash residue for discharging, the flow disturbance, solidification and blockage phenomenon of the molten slag is eliminated, the ash discharging process is simple, and the operation is smooth. The above content describes in detail the preferred embodiments of the present disclosure, but the present disclosure is not limited thereto. A variety of simple modifications can be made in regard to the technical solutions of the present disclosure within the scope of the technical concept of the present disclosure, including a combination of individual technical features in any other suitable manner, such simple modifications and combinations thereof shall also be regarded as the content disclosed by the present disclosure, each of them falls into the protection scope of the present disclosure.

The invention claimed is:

1. A process for preparing fuel gas through graded pyrolysis and gasification of powdered coal, the process comprises the following steps:

(1) contacting powdered coal having a particle size of not greater than 3 mm and ash residue in a riser reactor under hydrogenation conditions, performing a pyrolysis reaction and a gas-phase tar cracking reaction;

(2) subjecting the product obtained from step (1) to a primary gas-solid separation to obtain a gasified gas containing fine particle semi-coke and a solid fraction containing coarse particle semi-coke;

(3) subjecting the gasified gas containing fine particle semi-coke to a secondary gas-solid separation to obtain a solid fraction containing fine particle semi-coke and a gasified gas;

(4) feeding at least a portion of the solid fraction containing coarse particle semi-coke obtained from the primary gas-solid separation into a stepped turbulent fluidized bed through a material-returning device of fluidized bed, and contacting with an oxidant and water vapor to carry out a gasification calcination reaction to obtain a first high-temperature gasified coal gas and a high-temperature ash residue, flowing the first high-temperature gasified coal gas and at least a portion of high-temperature ash residue upwards and feeding into the riser reactor to provide the hydrogen atmosphere and the ash residue in step (1);

(5) feeding at least a portion of the solid fraction containing fine particle semi-coke obtained from the secondary gas-solid separation into an entrained-flow bed through a material-returning device of entrained-flow bed, and contacting with a gasifying agent to carry out a melting gasification reaction to obtain a second high-temperature gasified coal gas and a liquid residue, falling the liquid residue to the material-returning device of fluidized bed for cooling and solidification, and feeding the second high-temperature gasified coal gas to the riser reactor via a high-temperature gasified gas returning pipe to provide heat and hydrogenation atmosphere for the pyrolysis reaction and the gas-phase tar cracking reaction of step (1).

2. The process for preparing fuel gas through graded pyrolysis and gasification of powdered coal of claim 1, wherein the reaction temperature of the riser reactor in step (1) is within the range of 800-1,000° C.

3. The process for preparing fuel gas through graded pyrolysis and gasification of powdered coal of claim 1, wherein a mass ratio of the powdered coal to the ash residue is 1:(20-80).

4. The process for preparing fuel gas through graded pyrolysis and gasification of powdered coal of claim 1, wherein a particle size of the coarse particle semi-coke is larger than 30 μm; a particle size of the fine particle semi-coke is less than or equal to 30 μm.

5. The process for preparing fuel gas through graded pyrolysis and gasification of powdered coal of claim 1, wherein the bottom of the step turbulent bed is provided with a gas distributor.

6. The process for preparing fuel gas through graded pyrolysis and gasification of powdered coal of claim 1, wherein the temperature of the gasification calcination reaction in step (4) is within the range of 800-1,100° C.;

relative to 1 kg the solid fraction containing coarse particle semi-coke, the total flow volume of the oxidant and water vapor is 0.2-3 L;

the oxidant is an oxygen-containing gas, wherein the volume content of oxygen is within the range of 20-100%;

the volume ratio of the oxidant to water vapor is 1:(0.3-2.5).

7. The process for preparing fuel gas through graded pyrolysis and gasification of powdered coal of claim 1, wherein the temperature of the melting gasification reaction in step (5) is within the range of 1,200-1,600° C.;

relative to 1 kg the solid fraction containing fine particle semi-coke, the total flow volume of the gasifying agent is 0.1-3 L.

8. The process for preparing fuel gas through graded pyrolysis and gasification of powdered coal of claim 1, wherein the process further comprises: feeding the remainder high-temperature ash residue obtained from the gasification calcination reaction in step (4) into a calcination fluidized bed, mixing with a calcination gasification agent for calcination to obtain a ash residue of gasification without semi-coke, and discharging the ash residue of gasification.

9. The process for preparing coal gas through graded pyrolysis and gasification of powdered coal of claim 8, wherein the temperature of the mixing calcination is within the range of 900-1,100° C.; the calcination gasifying agent is an oxygen-containing gas, wherein the oxygen content of oxygen is 20-100% by volume.

10. The process for preparing fuel gas through graded pyrolysis and gasification of powdered coal of claim 1, wherein the operating state of the material-returning device of fluidized bed is a turbulent flow state, the returning wind of the material-returning device of fluidized bed is selected from water vapor and/or oxidizing gas, and the oxidizing gas is oxygen-containing gas with the volume content of oxygen within the range of 20-100%.

* * * * *